US005884800A

United States Patent [19]

Hall

[11] Patent Number: 5,884,800

[45] Date of Patent: Mar. 23, 1999

[54] CONTAINER LID WITH BAG SECURING APRON

[76] Inventor: Charles E. Hall, 709 Utz La., Hazelwood, Mo. 63042

[21] Appl. No.: 748,381

[22] Filed: Nov. 13, 1996

[51] Int. Cl.[6] ..... B65D 5/38

[52] U.S. Cl. ..... 220/495.03; 220/495.08

[58] Field of Search ..... 220/409, 407, 220/495.03, 495.08, 495.11

[56] References Cited

U.S. PATENT DOCUMENTS 3,262,606 7/1966 Waterman .
3,853,250 12/1974 Alpern .
3,872,996 3/1975 Dogliotti .
4,144,985 3/1979 Kinslow .
4,538,731 9/1985 Cillario .
4,759,478 7/1988 Richardson et al. .
5,027,999 7/1991 Kücherer .
5,547,109 8/1996 Robbins, III .

*Primary Examiner*—Joseph M. Moy
*Attorney, Agent, or Firm*—Howell & Haferkamp, L.C.

[57] ABSTRACT

A lid for a container having a channel around its bottom periphery for closing onto a container body. The lid has an opening partially surrounded by an apron on the lower side of the lid, and a cap fitting over the opening. Bagged solids may be placed into the container. The apron allows bagged solids to be conveniently dispensed by preventing the open end of the bag from interfering with solid poured through the opening.

19 Claims, 4 Drawing Sheets

CONTAINER LID WITH BAG SECURING APRON

BACKGROUND OF THE INVENTION

1. Field of the Invention

This invention relates to the field of containers from which substances can be stored and dispensed, and more particularly to a container lid with a bag securing apron and to a corresponding container assembly that is suitable for dispensing solid materials contained within a bag placed inside the container.

2. Description of the Prior Art

It is a common practice for consumers of such consumable, dispensable items as breakfast cereals to empty boxes or bags of cereals into plastic containers with lids that permit dispensing of the cereal within. As many cereals are being supplied in bags without the familiar printed cardboard boxes to reduce costs to consumers, this consumer practice may be becoming more common, because open bags of cereal may not stand up by themselves on storage shelves and can spill if they are not emptied into another container.

However, once the cereal is transferred to a plastic container, identification of the cereal in the container is problematic, as the original container is no longer available, and many cereals look alike. It would therefore be advantageous to provide a container with a lid that would permit the cereal bag itself, along with printing, to be inserted into the container, and which would allow the cereal to be dispensed from the container without removing it from the bag. It would also be advantageous if the container were essentially transparent, to allow any printing on the bag to be read from the outside of the container. Of course, such features would be advantageous for dispensing other materials not limited to cereals, and could be scaled in size to accommodate bags of widely varying sizes.

Furthermore, some foodstuffs (and other substances that can be placed in dispensing containers) have strong odors that can penetrate plastics and that resist removal. If a plastic container is used for more than one type of food, the odors that are left behind can cross-contaminate the foods, making them less palatable. The scent left behind from some types of salty snack foods could contaminate a sweet breakfast cereal that next fills and is dispensed from the container, for example. While the scent of each of these types of foods by themselves may be pleasant and appetizing in different ways, the combination may be substantially less so. It would therefore be desirable to provide a dispensing device that could avoid this sort of odor cross-contamination, whether for foods or for other solid products.

In the prior art there are many different types of containers and lids that could be employed in storing products that are sold packaged in bags. One example is disclosed in U.S. Pat. No. 3,853,250 to Alpern. Alpern discloses a lid for a fluid dispensing container that has a peripheral wall or skirt attachable at its lower portion to the exterior of the container neck, an open top on the outer portion of the wall defining a peripheral rim, and a pouring spout. A sleeve of the lid depends into the container when attaching the cover to the container. The sleeve is provided to ensure a fluid-tight seal between the lid and the container. Because the seal is designed for liquids, the seal extends all around the inside of the container. Such an arrangement is inconvenient for use with bagged solids, since it would be difficult to press the lid onto a container in such a manner as to hold the bag in an open position to facilitate pouring, unless the entire top of the bag were opened, draped over the top rim of the container, and held in place while the lid was placed on the container. However, even such an inconvenient arrangement of bag and lid might not be possible, because the fluid-tight fit of the lid and container might not accommodate a bag in the sealed region of the container. Moreover, the requirement to open the entire top of a bag such as a cereal bag increases the likelihood that at least a portion of the material contained within will be spilled before the bag is secured in the dispensing container. Furthermore, the requirement that a portion of the bag be draped over the top rim of the container limits the use of the lid and container to partially filled bags. (Opened, fully filled bags would spill a portion of their contents if the top portion of the bag were pulled down and back to drape over a rim.)

There is therefore a need for a lid and a corresponding container assembly that can be used to conveniently dispense such items as food from food product bags (e.g., cereal bags). There is also a need for a lid that can be inserted into a container that can accommodate bags without the inconvenience of having to open an entire top of the bag, although one should still be able to do that if one wishes to do so. Additionally, there is a need for a lid that can be inserted into a container that can accommodate bags that are fully filled to facilitate the dispensing of the contents thereof.

BRIEF DESCRIPTION OF THE INVENTION

The invention comprises, in one aspect, a container and a lid, the lid having a top and an underside, the underside having a periphery around which a channel is formed. A cap fits an opening in the top of the lid. An apron depends downwardly from the underside of the lid between the channel and the opening on the underside of the lid, the apron at least partially encompassing the opening. Preferably, the apron does not extend all the way around the lid close to the channel, so that it is easier to place the lid onto a bag in a container body without draping the open end of the bag over the container body's upper rim. Alternately, the apron may extend all the way around the lid close to the channel.

In another aspect of the invention, there is provided a lid in accordance with the above-described aspect of the invention and a container having a rim fitting into the channel of the lid. A wall extends around the opening of the lid and a cap is removably secured on the wall. Opposite sides of the opening wall are upwardly inclined so that when the cap is secured over the opening wall, the cap is upwardly inclined. The upward inclination of the cap positions its forward edge well-above the lid where it is easily grasped for opening.

It is thus an object of this invention to provide a lid that can be conveniently used to dispense such items as food from food product bags, such as cereal bags.

It is a further object of the invention to provide a lid that can be inserted into a container to dispense solid items from bags without the inconvenience of having to open an entire top of the bag.

It is yet a further object of the invention to provide a lid that can be inserted into a container that can accommodate fully filled bags to facilitate the dispensing of the contents thereof.

It is still another object of the invention to provide a container and a lid where the lid has a cap with an elevated edge that is easily grasped when opening the cap.

It is yet another object of the invention to provide a container and a lid that facilitates the dispensing of bagged materials, thereby protecting the container from the absorption of scents and odors from the dispensed materials.

These and other objects of the invention will become apparent to those skilled in the art from an inspection of the accompanying drawings coupled with a reading of the detailed description of the invention.

It should not be assumed that the figures are drawn to scale.

DETAILED DESCRIPTION OF THE INVENTION

Figure 1:
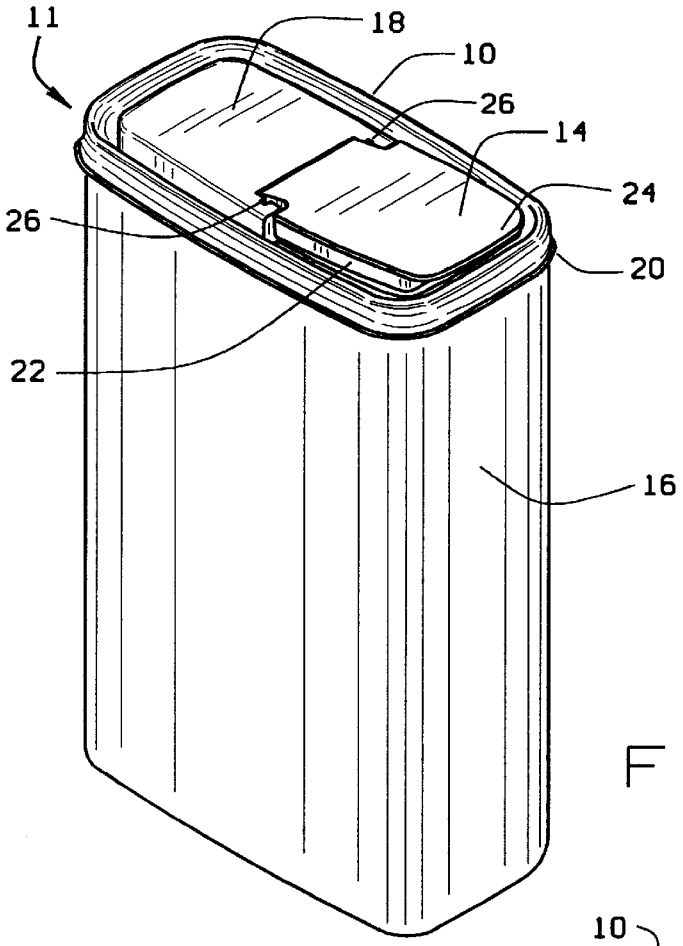
FIG. 1 is a perspective view of a container including a container lid in accordance with the invention.

FIG. 1 is a perspective view of a container 11 including a container lid 10 in accordance with the invention and a container body 16. In a preferred embodiment, the container body and the container lid 10 are made out of a suitably flexible plastic material, such as that used in prior art food storage containers. For the convenience of the user, container body 16 is preferably transparent enough to allow a user to see the contents inside, and even more preferably transparent enough to read labeling on a bag placed therein, as will become apparent below when the use of the container 11 is described. Container lid 10 may be transparent, translucent, or opaque, depending upon ease of manufacturing, market acceptance, or other factors not necessarily related to the invention. If lid 10 is transparent, however, the contents of an open bag placed into container 11 may advantageously be seen, even if the bag itself is not transparent.

The container lid 10 includes a reclosable cap 14, which, in the illustrated embodiment, is preferably hingedly attached to the container lid 10 by rotating hinge elements 26. Less preferably, any suitable attachment means for reclosable cap 14 may be used, one example of which is a flexible strap (not shown) attaching a reclosable cap to a surface such as surface 18 of the container lid 10, or alternately, the reclosable cap may be freely detachable from container lid 10. In the embodiment of FIG. 1, reclosable cap 14 can be flipped open to reveal an opening (not visible in FIG. 1) out of which material stored in container body 16 may be dispensed. A tab or ledge 24 is preferably provided to allow reclosable cap 14 to be lifted from the opening. A channel 20 (of which only an outer rim is shown in FIG. 1) is provided to allow attachment of container lid 10 to the open rim of container body 16 as illustrated. Preferably, a sealing mechanism should be provided for the channel 20 and the rim of container body 16 so that the container lid 10 does not fall off the container body 16 when the contents of the container body 16 are poured out, but the sealing mechanism should allow the container lid 10 to be relatively easily removed when it is desired to refill the container. Such closures are known in the art. (If container 11 is not to be refilled for some reason, the sealing mechanism need not allow lid 10 to be removed.)

Figure 2:
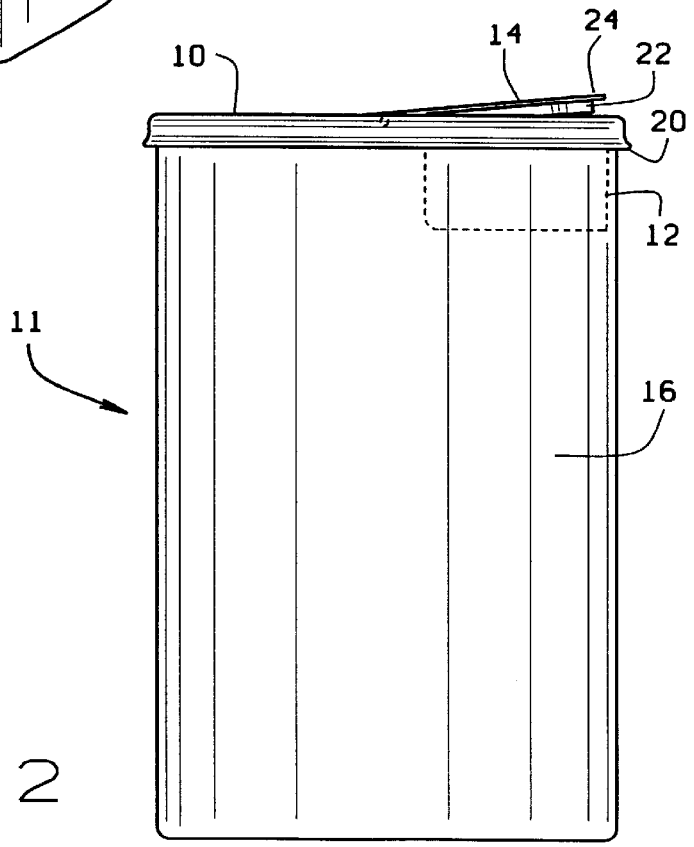
FIG. 2 is a side plan view of the container and lid of FIG. 1.

FIG. 2 shows a side plan view of the container 11, illustrating an apron 12 depending downwardly from the lid 10. Apron 12 surrounds an opening (not shown in FIG. 2) in lid 10 through which material inside container body 16 can be poured out when cap 14 is opened. Preferably, the opening is only partially surrounded. Apron 12 is also in proximate but spaced-apart relationship with the inner walls of container body 16, so that an open top of a bag (not shown in FIG. 2) can be held open and the contents of the bag can be poured out through the opening in lid 10 when cap 14 is opened. Apron 12 preferably is spaced from the inner walls of container body 16 by a distance that will permit a portion of the open top of a bag to be effectively held in place against the upper portion of one or more of the upright inner walls of container body 16 by apron 12. It should be noted that, while the "upright inner walls of container body 16" are to be distinguished from the bottom of the container body, the quoted term is not meant to exclude sloping inner walls, nor is it meant to exclude cylindrical containers (the latter of which might literally be considered as having only one "upright inner wall," although an appropriate modification to the invention would be obvious to one skilled in the art) from the invention. The engagement of the bag, apron 12, and the inner walls of container body 16 is described in more detail below.

Figure 3:
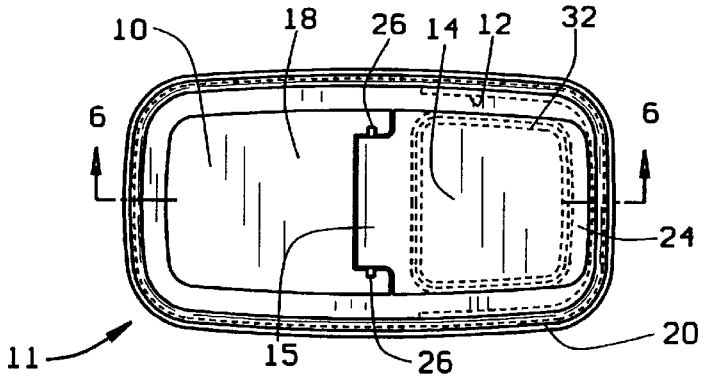
FIG. 3 is a top elevation view of the container and lid of FIG. 1.
Figure 4:
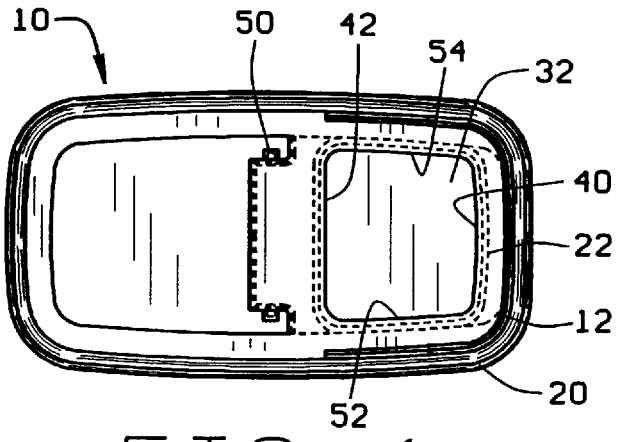
FIG. 4 is a bottom plan view of the lid shown in FIGS. 1–3.

FIG. 3 is a top elevation view of the container 11 showing the top of lid 10. Opening 32 in lid 10 is shown underneath cap 14 which is shown in its closed position. Pegs 26 (which may be integral to cap 14) extend sideways from a rear portion 15 of cap 14 and provide hinge action by being rotatingly engaged in a recessed region 50 of lid 10, and may be captured therein. Recessed region 50, as well as opening 32, are more clearly visible in FIG. 4, which is a bottom elevation view of container lid 10. FIG. 4 also more clearly shows channel 20, which fits around a rim of the container body. The extent to which apron 12 preferably surrounds opening 32 is also best shown in FIG. 4. Apron 12 depends downward from the bottom of lid 10 between channel 20 and opening 32. Apron 12 is preferably shaped to keep the opened walls of a bag contained within the container body from interfering with the dispensing of the contents of the bag through opening 32. In the embodiment shown in FIG. 4, to maximally facilitate pouring, apron 12 surrounds all sides of opening 32 except the side of opening 32 closest to the center of lid 10, or more precisely, the top portion of container 11 when the container is tilted to pour out its contents. In this respect, by being essentially U-shaped around opening 32, not only does apron 12 keep opening 32 free from obstruction when an opened bag is placed in container 11, as described below, but it also acts somewhat as a "scoop" or "funnel" to guide the contents into the opening as the contents are poured out.

Although it is contemplated that the inventive lid 10 may be made with an apron 12 that surrounds the entire inside perimeter of lid 10 inside of and proximate to channel 20, this may make it more difficult, in some situations, to fit a bag entirely inside the container body, as the apron would tend to push the bag back into the container body as the lid 10 was fit onto the container body. (This difficulty may be reduced, however, if the apron 12 is tapered, as described below.) With the apron 12 limited to only a portion of the lid (i.e., a "front" side, where opening 32 is formed), the lid can be pushed forward, pressing the apron against an inside portion of the opened bag before the lid is pressed down into place on top of the container body, and thus, one can readily avoid pushing the bag back into the body. Also, if apron 12 completely surrounded opening 32 and a rear portion of apron 12 were proximate the portion of opening 32 that is not surrounded by apron 12 in FIG. 4, the rear portion of apron might interfere with the pouring of material from a bag in the container body. Thus, in the view shown in FIG. 4, apron 12 should preferably be U-shaped, or at least have an open side in a direction such that, when the container 11 is tipped sideways for pouring out its contents, the apron is open towards the top in a region about as wide as opening 32, while otherwise surrounding opening 32 as much as possible. The apron should also depend downward proximately to only a portion of channel 20 of lid 10.

Figure 5:
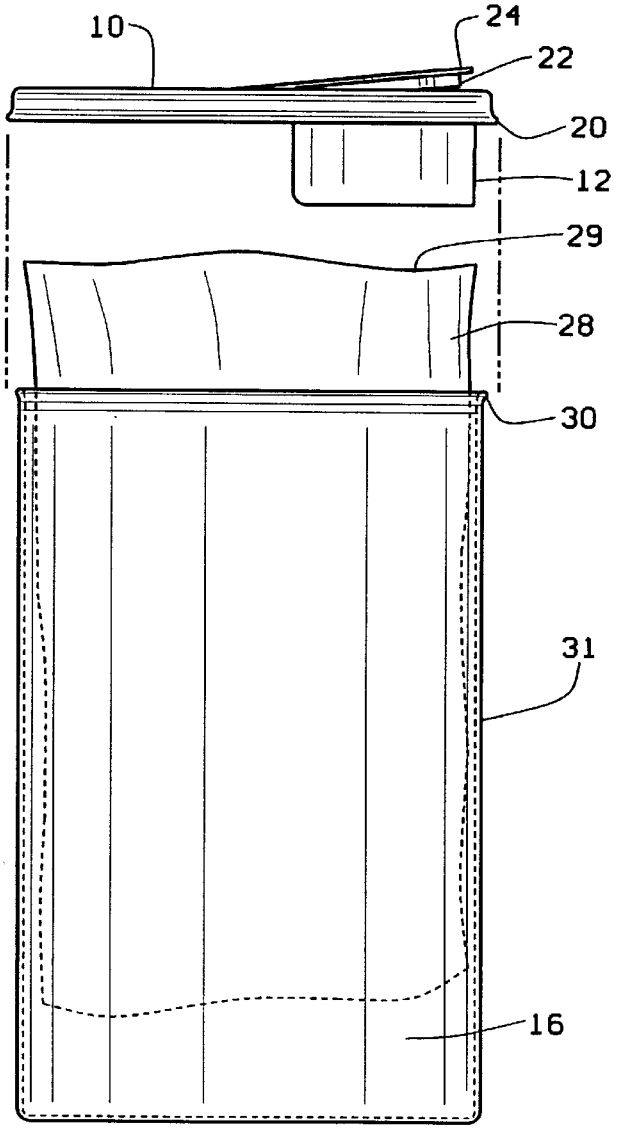
FIG. 5 is an exploded side view of the container and lid of FIG. 1 with a bag inserted in the container.

FIG. 5 is an exploded side elevation view of a container incorporating the inventive lid 10, showing the relationship of the container body 16, lid 10, and a bag 28 of dispensable material contained within container body 16. Bag 28, containing a dispensable solid such as a breakfast cereal, fits into the container body 16 and preferably is dimensioned so that, when the top 29 of bag 28 is opened, top 29 of bag 28 is approximately level with or slightly below the rim 30 of container bottom 16.

In use, bag 28 is slid into container body 16. Bag 28 can be opened either before it is placed in container body 16 or afterwards, but it may be more convenient to do so after it has been placed inside the container body to prevent the possibility of spilling the bag's contents. The top portion 29 of bag 28 must be opened enough so that the inner walls of the open bag can accommodate apron 12, permitting the open bag to freely communicate its contents through opening 32 in the lid 10 when the opening is not covered by cap 14. Lid 10 is then lowered into preferably removable sealing engagement with container body 16 so that lip 30 on the rim of container body 16 is engaged within channel 20 of lid 10, making sure that the bag opening is engaged between apron 12 and adjacent sections of the inner walls of the container body 16. It is not necessary that lid 10 be pressed directly down on container body 16 as might be implied from a literal interpretation of FIG. 5. Because apron 12 extends only partially around the bottom of lid 10, and preferably only around opening 32, it is possible to facilitate proper engagement of the top of bag 29 by tilting lid 10 so that the apron fits into the open bag before pressing lid 10 onto container body 16.

In actuality, the distance below rim 30 that can be readily accommodated for top 29 of bag 28 is determined by the extent to which apron 12 depends downward from lid 10, inasmuch as, in accordance with the invention, apron 12 holds top 29 of bag 28 against the inner walls of container body 16 when the lid 10 is engaged with the container body. It should also be apparent that bag 29 need not have its top completely opened. Instead, bag 29 must be opened only so much as is necessary to accommodate apron 12 into the opened part of the bag.

Figure 6:
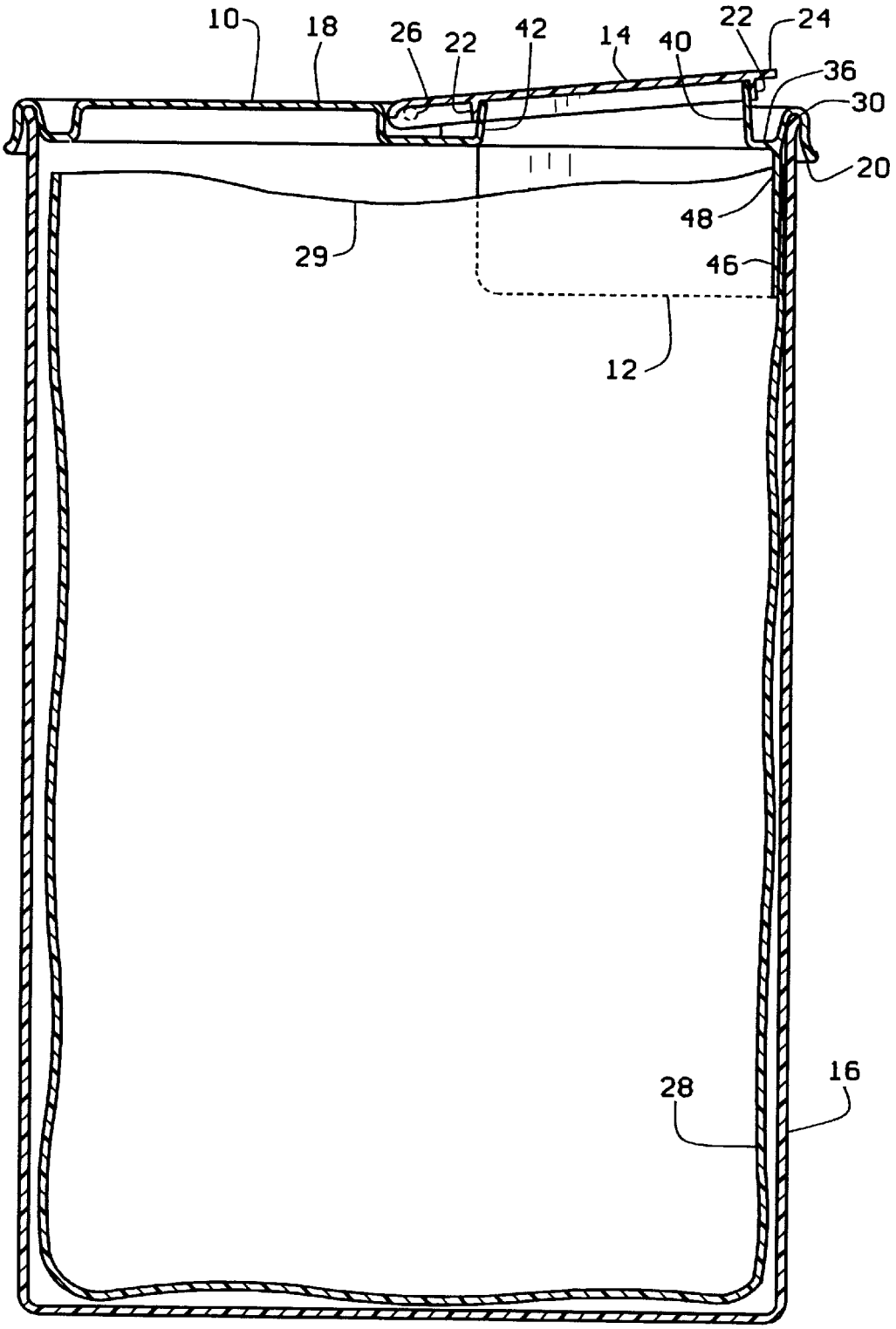
FIG. 6 is a side sectional cut-away view of the container and lid of FIG. 3 along section line 6—6.

FIG. 6 is a side sectional view of a container body, bag, and lid assembly taken along section line 6—6 of FIG. 3. It will be observed that at least a part of the opening of the top 29 of bag 28 is held in place between apron 12 and an inner wall of container body 16. It can perhaps best be appreciated from FIGS. 5 and 6 that, because apron 12 does not extend all the way around the perimeter of lid 10, the top 29 of bag 28 need not be draped over rim 30 of container body 16 and held in place when lid 10 is pressed onto the container body. If this were necessary, then either bag 28 could not be packed as full as would otherwise be possible, or a portion of its contents would have to be removed before the bag is placed in the container. Nevertheless, the design of the container still permits the top 29 of bag 28 to be draped over rim 30 of container body 16 if it is desired to do so. In particular, channel 20 can be made sufficiently wide to accommodate both rim 30 and a bag top 29 draped over the rim.

Figure 7:
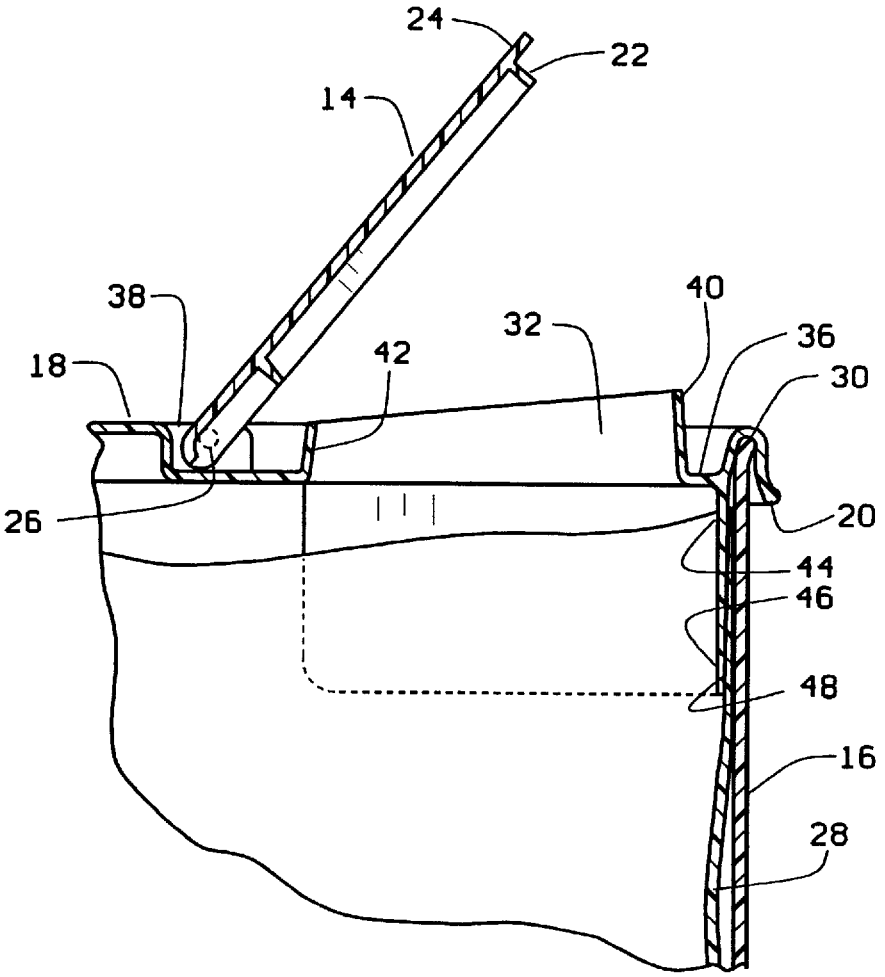
FIG. 7 is a partial side sectional view showing the relationship of the container lid, the container body, and a bag within the container body.

FIG. 7 is an enlarged view of a portion of FIG. 6 with cap 14 shown in the "open" position, ready to dispense the contents of bag 28. In the illustrated embodiment, cap 14 hingedly pivots on a pair of pegs 26, which are preferably integral to cap 14 and captured in a wall of a recess 38 in lid 10. Cap 14 preferably comprises walls 22 which may be frictionally engaged with upwardly extending walls 40, 42, 52, and 54 (the location of walls 52 and 54 are indicated in FIG. 4) surrounding opening 32. More generally, and without limiting the shape of opening 32, the wall or walls around opening 32 can be considered as forming a first lip around opening 32, which engages a second lip (i.e., wall 22, in the illustrated embodiment) on cap 14. Other types of closures, including a positive closure such as a latch, may be employed if desired.

In the illustrated embodiment, wall 40 is higher than wall 42, and the height of walls 52 and 54 vary between these walls to allow the closure of cap 14 at a slightly angled position, which, in this embodiment, facilitates the lifting of the end of cap 14 opposite from the pivot or hinge formed by pegs 26. A tab or ledge 24 is preferably provided at this end of cap 14. Wall 40 is preferably somewhat higher than the top outer wall of channel 20 to increase the accessibility of tab or ledge 24 and to guide solid material from bag 28 over the top part of the outer wall of channel 20. Also, wall 40 is spaced somewhat therefrom, forming a recess 36 where a finger may be inserted to lift tab or ledge 24 to open cap 14. It should be understood that the term "ledge" as used herein may be considered as referring to a type of tab, specifically, one that extends the length of a side of cap 14. As indicated above, other closure arrangements would be apparent to those skilled in the art and do not have to adhere to the particular details described herein.

Apron 12, which depends downward from lid 10, does so from a region between an inner wall of channel 20 and a wall 40, 52, or 54 (walls 52 and 54 as shown in FIG. 4). As in the illustrated embodiment in FIG. 7, apron 12 may be tapered in width from a relatively wider region 44 nearer the bottom of lid 10 to a relatively more narrow region 46 near the bottom portion of apron 12. If apron 12 depends from lid 10 from a region proximate channel 20, this tapering produces a tapered region between apron 12 and the inner wall or walls of container body 16. This tapering, in combination with the preferably flexible plastic of which the materials comprising the lid 10 and container body 16 are made, can facilitate gripping of an upper portion 48 of bag 28 to more positively assure that opening 32 remains unobstructed by bag 28. (As mentioned above, this tapering may also help to reduce the tendency of an apron 12 to push the upper portion of a bag inside the container away from the apron, in case the lid 10 is made with apron 12 extending completely, rather than partially, around the container lid proximate channel 20.) However, if bag 28 is made of sufficiently stiff material, it may not be necessary to grip the top portion 48 of bag 28 between apron 12 and a wall or walls of container body 16. Instead, apron 12 may depend from lid 10 from positions closer to opening 32, resulting in apron 12 being in spaced-apart relationship from the inner walls of container body 16 when lid 10 is engaged with container body 16. In this case, the stiffness of the upper portion 48 of open bag 28 combined with the barrier presented by apron 12 serves to keep opening 32 free-flowing when cap 14 is lifted, and any size bag that has or can have an opening that can be supported in the space between apron 12 and the inside wall or walls of container body 16 can be used, as long as the bag 28 can be held in place by the mechanical action of the apron 12 during the tilting of the container to dispense the contents of the bag.

In a typical application, a cereal bag 28 would be opened at its top and then inserted into container body 16 open end up, or alternately, the bag could be inserted into the container body and then opened. Lid 10 would then be pressed into place over the rim of container body 16, making sure that apron 12 is placed within the opening of bag 28 so that the opening in the lid is prevented from being blocked or interfered with by the open end of the bag. Note that the bag need only be opened sufficiently to accommodate insertion of the apron 12. The user would open cap 14 when it was desired to dispense cereal from the container, and closed when it is desired to keep the cereal from spilling and to keep it fresh and secure in the container. When the bag of cereal is empty, lid 10 can be removed, allowing replacement of the empty bag of cereal with one that is full. Indicia printed on the side of the bag can be seen through the container body if the container body is transparent, and the cereal can be seen through the bag, if the bag is also transparent. Of course, the inventive lid and container assembly can be used to dispense other types of bagged (as well as unbagged) solids as well. If these materials are bagged, it is readily observed that the presence of the bag inside the container will assist in preventing odors from these materials from penetrating the container material and cross-contaminating other subsequently dispensed materials.

The examples in above description are intended to be exemplary only, inasmuch as various modification will be apparent to those skilled in the art that do not depart from the spirit of the invention. Because the examples in the description are not intended to be limiting, the scope of the invention should be measured by reference to the attached claims, including the full range of equivalents thereof in accordance with applicable law.

What is claimed is:

1. A lid for a container, said lid having a top and an underside, said underside having a periphery, said lid comprising:

a) a channel formed around the periphery of the underside of said lid;

b) a cap fitting an opening in said lid; and c) an apron depending downwardly from said lid between said channel and said opening in said lid on the underside of said lid, said apron partially encompasses the opening in said lid, and said apron is proximate less than the entirety of said channel.

2. The lid of claim 1 wherein the channel includes an outer rim and an inner wall that extend around the periphery of the lid underside.

3. The lid of claim 1 wherein said apron has a tapered profile, being thicker near to and thinner farther from the underside of said lid.

4. The lid of claim 1 wherein a profile of said apron encompassing the opening is U-shaped.

5. The lid of claim 1 wherein said lid further comprises an upwardly directed first lip about the opening, said upwardly directed first lip being spaced from said channel in the underside of said lid.

6. The lid of claim 5 wherein said cap comprises a second downwardly depending second lip that engages said first lip when said cap is closed.

7. The lid of claim 6 wherein said cap is hingedly engaged with the top of said lid.

8. The lid of claim 6 wherein said upwardly directed first lip is spaced from and extends above an uppermost portion of said channel and said cap includes a tab portion above and outside of said downwardly extending second lip and that is spaced above the uppermost portion of said channel when the opening in said lid is closed, so that said cap can be opened by lifting said tab portion with a finger.

9. A dispensing container comprising:

a) a lid having a top and an underside, said underside having a periphery, said lid comprising:

i) a channel formed around the periphery of the underside of the lid;

ii) a cap fitting an opening in said lid, and iii) an apron depending downwardly from said lid between said channel and said opening in said lid on the underside of said lid, said apron partially encompassing the opening in said lid; and b) a container body having an upper rim fitting into said channel.

10. The dispensing container of claim 9 wherein said container body includes an upward inner wall, and said apron is spaced from said upward inner wall when said lid is fitted onto the upper rim of said container body.

11. The dispensing container of claim 10 and further comprising an open bag, a portion of said bag being disposed between said inner wall and said apron to prevent obstructing the opening, the opening in said lid being positioned over an opening in said bag.

12. The dispensing container of claim 11 wherein said apron has a tapered profile, being thicker near to and thinner farther from the underside of said lid, and said bag is held in place against said upward inner wall of said container body by said apron.

13. The dispensing container of claim 10 wherein said apron partially encompasses the opening in said lid, and said apron is proximate less than the entirety of said channel.

14. The dispensing container of claim 10 wherein a profile of said apron encompassing the opening is U-shaped.

15. The dispensing container of claim 10 wherein said lid further comprises an upwardly directed first lip about the opening, said upwardly directed first lip being spaced from said channel in the underside of said lid.

16. The dispensing container of claim 15 wherein said cap comprises a second downwardly depending second lip that engages the first lip when said cap is closed.

17. The dispensing container of claim 16 wherein said cap is hinged in a recess in the top of said lid.

18. The dispensing container of claim 17 wherein said upwardly directed first lip is spaced from and extends above an uppermost portion of said channel and said cap includes a tab portion above and outside of said downwardly extending second lip and that is spaced above the uppermost portion of said channel when the opening in said lid is closed, so that said cap can be opened by lifting said tab portion with a finger.

19. The lid of claim 9 wherein the channel includes an outer rim and an inner wall that extend around the periphery of the lid underside.

* * * * *